US006580401B1

(12) United States Patent
Gerhard

(10) Patent No.: US 6,580,401 B1
(45) Date of Patent: Jun. 17, 2003

(54) BIFOCAL PLANAR ANTENNA

(75) Inventor: Walter Gerhard, Lubeck (DE)

(73) Assignee: Pates Technology Patentverwertungs-Gesellschaft fur Satelliten und moderne Informationstechnologien mbH, Lubeck (DE)

( * ) Notice: Subject to any disclaimer, the term of this patent is extended or adjusted under 35 U.S.C. 154(b) by 0 days.

(21) Appl. No.: 09/806,740

(22) PCT Filed: Jul. 28, 1999

(86) PCT No.: PCT/EP99/05400

§ 371 (c)(1),
(2), (4) Date: May 25, 2001

(87) PCT Pub. No.: WO00/21154

PCT Pub. Date: Apr. 13, 2000

(30) Foreign Application Priority Data

Oct. 5, 1998 (DE) ..... 198 45 868

(51) Int. Cl.[7] ..... H01Q 21/00
(52) U.S. Cl. ..... 343/853; 343/893
(58) Field of Search ..... 343/853, 700 MS, 343/737, 742, 746, 767, 751, 770, 776, 893, DIG. 2, 765; H01Q 21/00

(56) References Cited

U.S. PATENT DOCUMENTS 5,404,145 A * 4/1995 Sa et al. ..... 343/700 MS
5,552,798 A * 9/1996 Dietrich et al. ..... 343/895
6,031,498 A * 2/2000 Issler ..... 343/703
6,037,903 A * 3/2000 Lange et al. ..... 343/700 MS
6,229,484 B1 * 5/2001 Sagisaka ..... 343/700 MS
6,239,762 B1 * 5/2001 Lier ..... 343/770

FOREIGN PATENT DOCUMENTS

| | | | |
|---|---|---|---|
| DE | 0825 670 A1 | 8/1996 | ..... H01Q/1/44 |
| DE | 196 33 147 A1 | 8/1996 | ..... H01Q/19/17 |
| DE | 197 12 510 A1 | 3/1997 | ..... H01Q/1/36 |
| JP | 0 345 454 A1 | 4/1989 | ..... H01Q/21/00 |
| JP | 0920 075 A1 | 6/1998 | ..... H01Q/21/29 |

* cited by examiner

*Primary Examiner*—Don Wong
*Assistant Examiner*—Trinh Vo Dinh
(74) *Attorney, Agent, or Firm*—Woodbridge & Associates; Richard C. Woodbridge, Esq.; Thomas J. Onka, Esq.

(57) ABSTRACT

A microwave antenna is described, capable of simultaneous maximum gain communication with N≧2 satellites in geostationary orbit. The orbiting satellites are positioned offset relative to each other at a specific azimuth angle(s) ϕ. The microwave antenna has radiating elements that are divided into N groups (1*a*, 1*b*; 1*a'*, 1*b'*; 1*a"*, 1*b"* 1*c*") of radiating elements. The antenna is characterized by the fact that each of the N groups of radiating elements is organized in a plane, with the planes arranged at specific angles relative to one another corresponding to the respective azimuth offset angle of the satellite to be communicated with, such that the surface normal ($F_N$) of the planes, once the microwave antenna is oriented, point in the direction of the respective satellites.

9 Claims, 4 Drawing Sheets

BIFOCAL PLANAR ANTENNA

Figure 1:
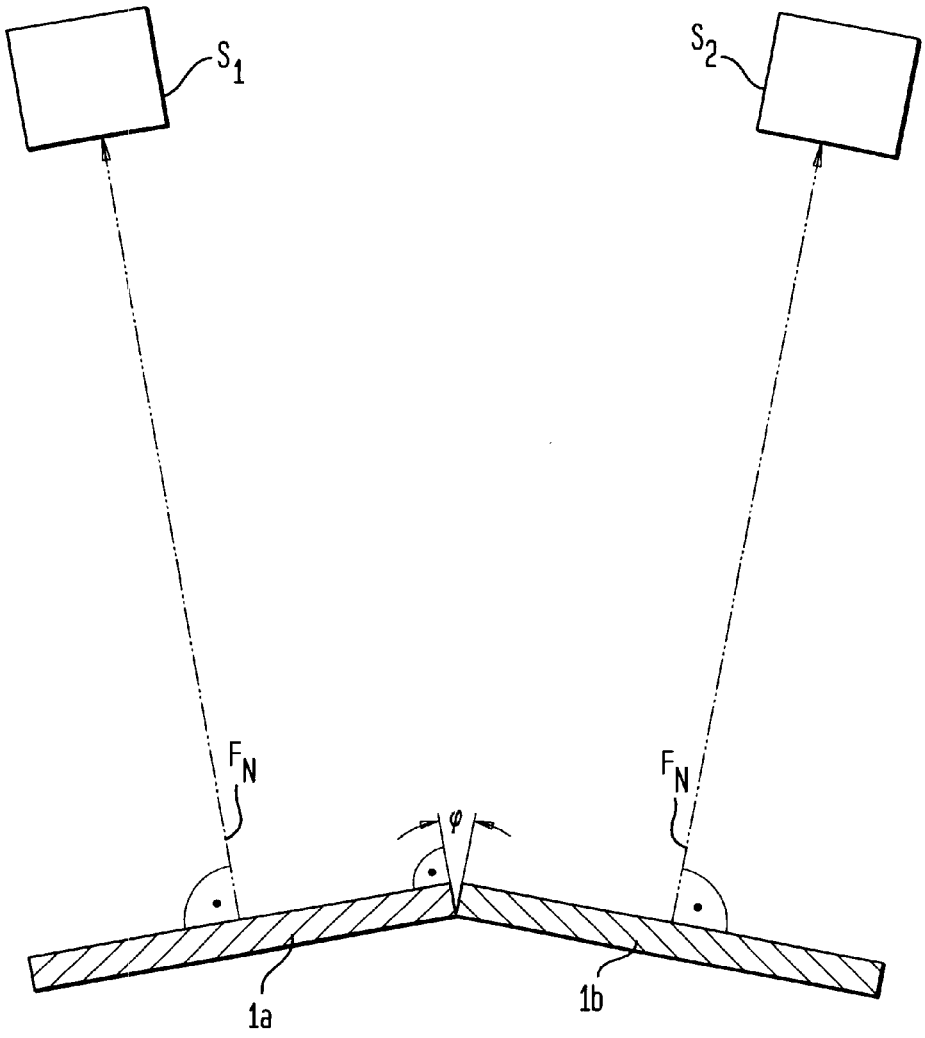

The invention relates to a microwave antenna for simultaneous reception of radiation fields of N≧2 satellites on orbit at azimuthally offset specific positions with respect to one another, whereby the microwave antenna includes radiation components that are divided into N groups, wherein each group is coupled to an input point via a line distribution network [server].

Antennas are known to the art that can be directed sequentially to different satellites by means of an automatic swivel device. The disadvantage in said antennas is, on the one hand, that they do not allow simultaneous reception of satellite signals from different satellites and, on the other hand, they require costly swivel devices.

DE 196 33 147 discloses a multi-focus-reflector antenna, wherein two radiation exciters are easily arranged in a line with the focal point of the parabolic reflector used in such a manner that the signals of two satellites can be received simultaneously without swiveling the antenna. The disadvantage in said antennas is the fact that the radiation exciters cannot be aligned directly in the focal point of the parabolic reflector, whereby the gain of the antenna compared with the reflector size is not optimal.

In order to eliminate said disadvantage, further parabolic antennas are known in the art, wherein a radiation exciter is arranged moveably on a line in front of the reflector, so that with a stationary parabolic reflector several satellites can be intercepted. The disadvantage in this arrangement is the fact that again an expensive positioning device is required for the radiation exciters and the gain of the antenna through the radiation exciters that are not arranged in the focal area is not optimal.

EP 0 825 670 discloses a multifunctional roofing element. Several of such roofing elements can be combined next to each other as a group in place of roofing tiles on the roof of a building for the purpose of receiving satellite signals. The disadvantage in said arrangement is, however, that the antenna, because of the orientation of the building or the concerned roof, is in most cases not suitable for a specific satellite, such that a relatively large number of roofing elements are required in order to afford sufficiently satisfactory reception.

Furthermore, planar antennas are known in the art that allow reception of the satellite signals only from those satellites to which they are directed. Positioning devices for selective directioning to several satellites are known in the are also for use with planar antennas.

The purpose of this invention is to provide a microwave antenna that allows simultaneous reception of several satellites that are azimuthally offset from each other in geostationary orbit without a swivel device.

This purpose is achieved by the invention by a microwave antenna with the characteristics described in claim 1. Said antenna is characterized by the fact that the face provided with radiation elements is sectioned into individual microwave antennas, whereby each microwave antenna exhibits several radiation exciters. Each of said microwave antennas forms a particularly planar or even surface. Said surfaces are arranged at specific angles relative to one another that correspond to the respective azimuthal offset of the satellite to be received. In a simple embodiment, only two groups of radiation elements are present, so that he signals from two satellites can be received. However, more than two satellites can be received simultaneously by the use of the respective number of radiation element groups.

A group of radiation elements can be arranged either next to one another or behind one another. If the groups are arranged behind one another in the direction of radiation then it must be possible for the electromagnetic radiation of the satellite whose signals are to be received by a group of radiation elements that are arranged behind one or several other groups another in the direction of radiation, can pass unimpaired through the interposed groups. If shades such as those described in the exemplar embodiments are used, then they must be arranged in a manner so that the radiation fields can reach the groups in the back through the shade groups situated up front.

The advantage of the microwave antenna described in the invention is that no swivel or positioning device whatsoever is required and it guarantees the maximum gain for each component microwave antenna or flat antenna, whereby a group of radiation elements forms each component microwave antenna.

A further advantage is when at least two radiation element groups are arranged behind one another in the direction of radiation for simultaneous reception from two different polarization directions and/or polarization types.

In a particular embodiment, a dielectric substrate, especially a dielectric foil, carries the circuit distribution nets of several groups. The minimal thickness of the carrier substrate allows this arrangement to be easily bent at required angle corresponding to the azimuthal angle.

In a further particular embodiment the microwave antenna exhibits at least two conductive layers arranged parallel to one another, especially conductive plates, wherein recesses or hollow spaces lying opposite one another are provided such that a dielectric substrate having one or several coupling networks is arranged between each pair of sequential layers, whereby the extremities of each coupling network is oriented towards the recesses or hollow spaces in order to form the radiation elements with same.

The paired conductive layers or plates can herein be fabricated as separate elements or as plates or, however, all conductive layers of the component microwave antennas can be formed by folded conductive plates that are arranged parallel to one another. Herein at least two coupling networks are arranged next to each other between the plates and form the radiation elements together with the plates.

In the last-described embodiment of the inventive microwave antenna at least one spacer element, in particular a dielectric foil with low dielectric number is arranged between each conductive layer or plate and each coupling network.

Thus, in the inventive microwave antenna, several planar antennas are arranged next to each other in a housing, whereby the surface normal of the antennas, in the directed condition of the microwave antenna, face in the direction of the respective correspondent satellite.

When constructing the microwave antenna it must merely be directed towards a satellite. Inasmuch as the microwave antenna is set up for simultaneous reception of signals of two satellites, the alignment with the second satellite can be eliminated, since the two component microwave antennas are already arranged at the correct angle to one another inside the housing.

A further advantage is provided in that only one housing is required for several satellites. If several individual flat antennas with separate housing were arranged next to each other, such an arrangement would require considerably more space when compared to the inventive solution.

Figures 2, 3, 4:
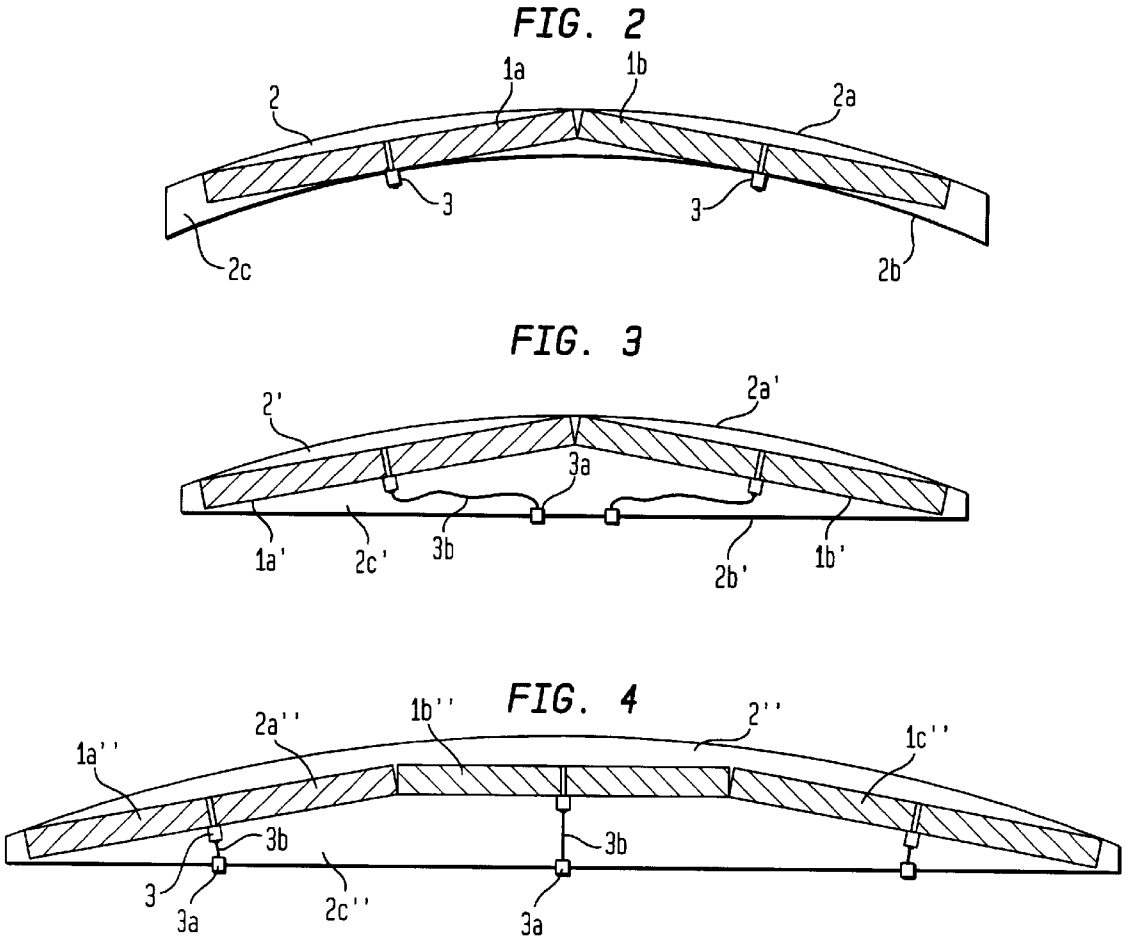
Figure 5:
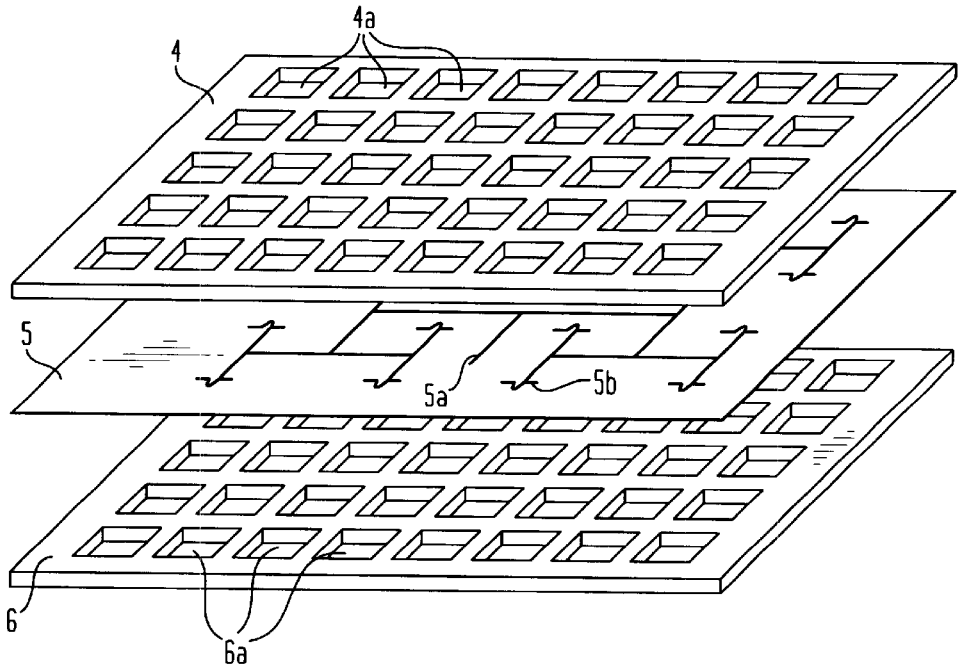
Figure 6:
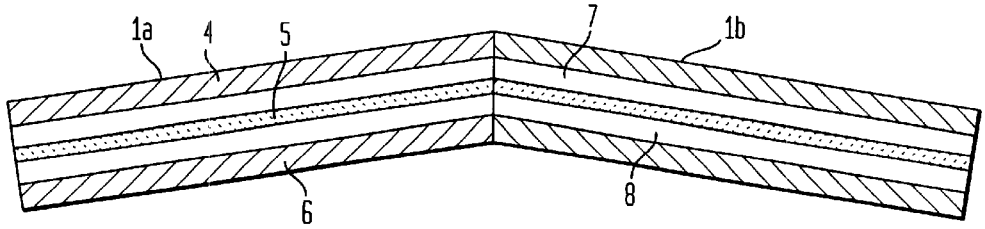
Figure 7:
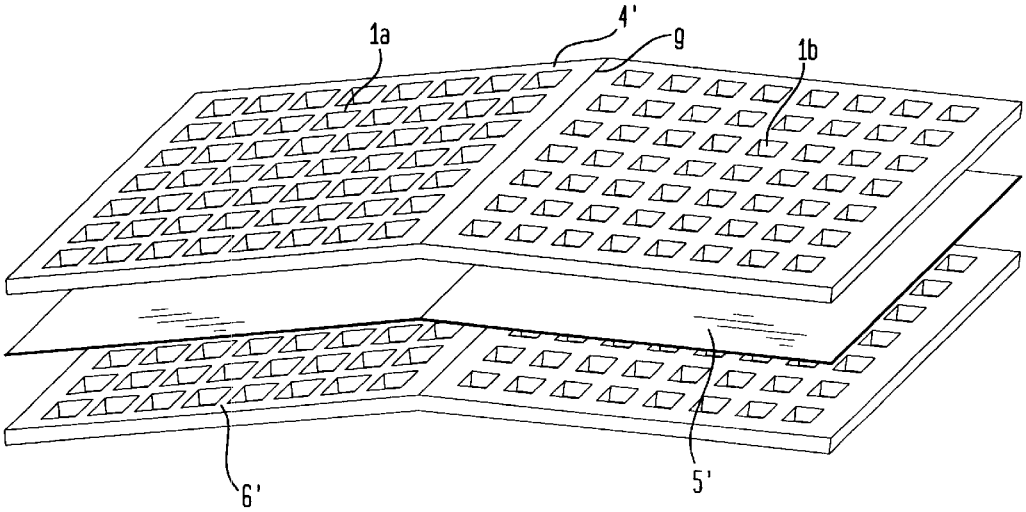
Figure 8:
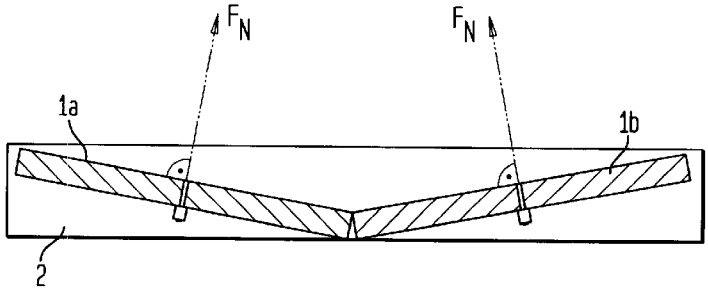
Figure 9:
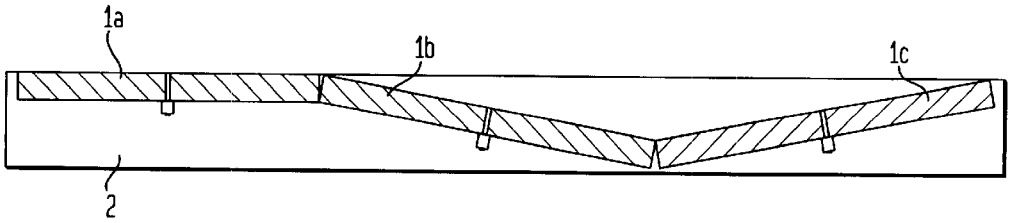

Exemplar embodiments of the invention are described in detail in the following using drawings, wherein FIG. 1: depicts a side-view of the schematic arrangement of two flat antennas, which together form the inventive microwave antenna for simultaneous reception of signals from two satellites;

FIGS. 2 to 4: depict cross-sectional representations of further embodiments by the inventive microwave antenna;

FIG. 5: depicts the schematic structure of a state of the art microwave flat antenna;

FIG. 6: depicts a cross-sectional representation of the microwave antenna;

FIG. 7: depicts the schematic structure of the microwave antenna in which the operationally identical components of the two flat antennas are fabricated in one piece;

FIGS. 8 and 9: depicts further embodiments of the inventive microwave antenna.

FIG. 1 depicts a microwave antenna comprised of two flat antennas 1*a* and 1*b* arranged next to each other. The surface normals $F_N$ of the two flat antennas 1*a* and 1*b* together form the angle $\phi$, which corresponds to the azimuthal angle between the two satellites whose signals are to be received by the two flat antennas 1*a* and 1*b*. The two flat antennas 1*a* and 1*b* are merely drawn in illustratively. It is thus possible to provide two separately fabricated flat antennas. It is likewise possible, as shown in FIG. 7, to fabricate the two flat antennas 1*a* and 1*b* out of two parts belonging together.

FIGS. 2 to 4 depict further possible embodiments of the inventive microwave antenna. The realization of the housing 2, 2' and 2" is optional and is essentially dependent on whether two (FIGS. 2 and 3) or several flat antennas, for example, as depicted in FIG. 4, in which three flat antennas 1*a*", 1*b*" and 1*c*", are arranged next to each other. In addition, the shape of the housing can be boxlike.

Unnecessary edges on the housing are eliminated by the round, cylinder-like shaped realization of surfaces 2*a*, 2*a*', and 2*a*" of the housing 2, 2', and 2" facing the satellite. Moreover, it is also possible the select the form of the housing so that the distance between the surface of each individual flat antenna to the wall of the housing is the same at all points.

The shape of the housing should, if at all possible, be such that the low-noise-converter 3 in the housing 2, 2' and 2" itself is accommodated and thus is protected from external influences.

The individual flat antennas are arranged inside 2*c*, 2*c*', 2*c*" of the housing, as depicted in FIGS. 2 to 4. The flat antennas can be mounted in the housing using positioning and or fixation elements. In a further embodiment the flat antennas are molded into the housing.

In all cases, especially at the back of the housing 2*b*, 2*b*', 2*b*", a number of connection plugs 3*a* must be provided corresponding to the number of flat antennas arranged in the housing; said plugs are coupled with the low-noise-converters 3 by means of connection circuits. The connector plugs must be arranged as close to one another as possible so that the connector cables can be led off from the microwave antenna for ease in installation.

FIG. 5 depicts the schematic structure of a flat antenna as disclosed, for example in DE 197 12 510. The radiator elements are arranged matrix configuration and are comprised of the shades 4*a*, 6*a* and the exciting or coupled strip-like or coupled-out conductor segments 5*b*. The received signals are conducted to a coupling out point (not shown)—also called a input—via a coupling network, and from said point the signals reach the low-noise-converter via a coaxial wave circuit. The shape of the shades 4*a* and 6*a* must be selected relevant to the requirements imposed on the wide-band characteristics and the type of nature of the polarization type to be received.

The individual elements 4, 5 and 6 are spaced apart by flat insulation material 7 and 8. As depicted in FIG. 6, the two adjacent flat antennas 1*a* and 1*b*, in which the shade masks 4' and 6' and the coupling network 5' for the two flat antennas 1*a* and 1*b* or/and the two radiation element groups are single piece. Herein the shade masks 4' and 6' are fabricated in two steps: First, the shades are stamped into a flat piece of metal sheet. Then the sheet metal is bend at the join line of the two radiation elements groups in such a way that the two surface normals $F_N$ of the two radiation element groups together form the azimuth angle. The two coupling networks can likewise be applied simultaneously to a single substrate carrier. The insulation materials (not shown in FIG. 7), such as foam mats, that assure the spacing between the parts 4', 5' and 6' can likewise be one-piece for each situation, since they are, like the substrate carrier, easily bendable.

FIG. 8 depicts a further possible embodiment of the inventive microwave antenna, wherein, for example, the two flat antennas are arranged next to each other and at an angle to each other so that the satellite signals to be received by the microwave antenna cross.

Inasmuch as more than two different satellites are to be received by means of on antenna, it is possible for space considerations to arrange the flat antennas as shown in FIG. 9. Through said arrangement the microwave antenna housing height is minimized.

It is obvious that also antenna technology other than that described in the foregoing can be used as the inventive microwave antenna.

What is claimed is:

1. A microwave reception system, comprising:

a first geo-stationary satellite;

a second geo-stationary satellite, said second satellite being offset from said first satellite by a fixed azimuth angle;

a first planar antenna comprising a first group of radiating elements, wherein the normal of said first planar antenna is oriented to point substantially directly at said first geo-stationary satellite and wherein said first group of radiating elements are connected via a first distribution system to a first connecting plug; and a second planar antenna comprising a second group of radiating elements, said second planar antenna being fixedly attached to said first planar antenna such that the normal of said second planar antenna is offset from the normal of said first planar antenna by said fixed azimuth angle and thereby oriented to point substantially directly at said second geo-stationary satellite and wherein said second group of radiating elements are connected via a second distribution system to a second connecting plug;

whereby said first and second planar antennas simultaneously provide substantially maximum gain reception of microwave receptions from said first and second geo-stationary satellites.

2. A microwave reception system, comprising:

a plurality of geo-stationary satellites, each of said satellites being offset from each other by fixed azimuth angles; and a plurality of planar antennas, each comprising a group of radiating elements, said planar antennas being fixedly attached to each other such that the normal of each planar antenna is offset from the normal of another planar antenna by one of said fixed azimuth angles such that said normals are each oriented to point substantially directly at one of said geo-stationary satellites and wherein each of said group of radiating elements are connected via a distribution system to a connecting plug;

whereby said planar antennas simultaneously provide substantially maximum gain reception of microwave receptions from all of said geo-stationary satellites.

3. The microwave reception system according to claim 2, characterized by the fact that said groups of radiating elements are arranged adjacent to each other, in particular arranged abutting one another.

4. The microwave reception system according to claim 2 or claim 3, characterized by the fact that a dielectric substrate, in particular a dielectric foil, carries said line distribution systems of several of said groups of radiating elements.

5. The microwave reception system according to one of claims 2 to 4, characterized by the fact that for reception of $Z \geqq 2$ polarizations and/or satellite directions, an equal number of line distribution systems are arranged in series in the direction of radiation.

6. The microwave reception system according to one of the above claims, characterized by the fact that said planar antennas are comprised of two or more conductive layers in particular circuit boards, arranged parallel to each other, in which opposing grooves or recesses are provided such that a dielectric substrate having one or more line distribution systems is arranged between each pair of conductive layers, and in which line distribution terminals of each line distribution system are directed to the grooves or recesses in order to form with these latter the radiating elements.

7. The microwave reception system according to claim 6, characterized by the fact that the paired conductive layers or plates, between which at least two line distribution systems are arranged alongside each other, together with said latter, form said groups of radiating elements, whereby each conductive layer or plate is divided into a number of levels or planes which corresponds to the number of line distribution systems, whereby the surface normals of said levels or planes are each parallel to the surface normals of the respective, corresponding line distribution system.

8. The microwave reception system according to claim 7, characterized by the fact that at least one spacer element, in particular a dielectric foil with a low dielectric number is arranged between conductive layers or plates and line distribution systems.

9. A microwave reception system, comprising:

a plurality of geo-stationary satellites, each of said satellites being offset from each other by specific azimuth angles; and a plurality of planar antennas, each of said antennas comprising a group of radiating elements and each of said antennas being located inside a housing and being arranged next to each other and fixedly attached to each other such that the normal of each planar antenna is offset from the normal of another planar antenna by one of said specific azimuth angles such that said normals are each oriented to point substantially directly at one of said geo-stationary satellites.

* * * * *